US007243659B1

(12) United States Patent
Lecoultre et al.

(10) Patent No.: US 7,243,659 B1
(45) Date of Patent: Jul. 17, 2007

(54) RECESS FILTER AND SMOKEABLE ARTICLE CONTAINING A RECESS FILTER

(75) Inventors: Etienne Lecoultre, Cortaillod (CH); Thomas Badertscher, Cernier (CH)

(73) Assignee: Philip Morris USA Inc., Richmond, VA (US)

( * ) Notice: Subject to any disclaimer, the term of this patent is extended or adjusted under 35 U.S.C. 154(b) by 309 days.

(21) Appl. No.: 10/332,455

(22) PCT Filed: Jul. 12, 2000

(86) PCT No.: PCT/EP00/06638

§ 371 (c)(1),
(2), (4) Date: Jul. 8, 2003

(87) PCT Pub. No.: WO02/03819

PCT Pub. Date: Jan. 17, 2002

(51) Int. Cl.
*A24D 3/04* (2006.01)

(52) U.S. Cl. ..... 131/341; 131/344; 131/331

(58) Field of Classification Search ..... 131/361, 131/331, 341, 344
See application file for complete search history.

(56) References Cited

U.S. PATENT DOCUMENTS 2,106,062 A 1/1938 Rawlings
4,357,950 A * 11/1982 Berger ..... 131/338
4,481,959 A * 11/1984 Byrne ..... 131/336
4,564,030 A * 1/1986 Jessup et al. ..... 131/336
4,580,584 A * 4/1986 Reynolds et al. ..... 131/336
4,611,607 A * 9/1986 Reynolds et al. ..... 131/336
4,643,206 A * 2/1987 Reynolds et al. ..... 131/336
6,827,087 B2 * 12/2004 Wanna et al. ..... 131/365

FOREIGN PATENT DOCUMENTS

| | | | |
|---|---|---|---|
| DE | 1056023 | | 4/1959 |
| GB | 2 210 546 | | 6/1989 |
| GB | 2210546 | * | 6/1989 |
| WO | WO 00/00047 | | 1/2000 |
| WO | WO00/00047 | * | 1/2000 |

* cited by examiner

*Primary Examiner*—Steven P. Griffin
*Assistant Examiner*—Jason L. Lazorcik
(74) *Attorney, Agent, or Firm*—Buchanan Ingersoll & Rooney PC

(57) ABSTRACT

The invention relates to a recess filter with a cavity associated with the mouth and provided with a cavity wall, in addition to one or more filter elements associated with the tobacco. The cavity wall surrounds either the cavity or the cavity and, at the most, one part of the filter element(s), whereby ambient air can enter the filter element(s) from the side in order to provide sufficient ventilation. The invention also relates to a stack of several recess filters in addition to a smokeable article, especially a cigarette or cigarillo comprising one such recess filter.

29 Claims, 6 Drawing Sheets

RECESS FILTER AND SMOKEABLE ARTICLE CONTAINING A RECESS FILTER

Figure 1:
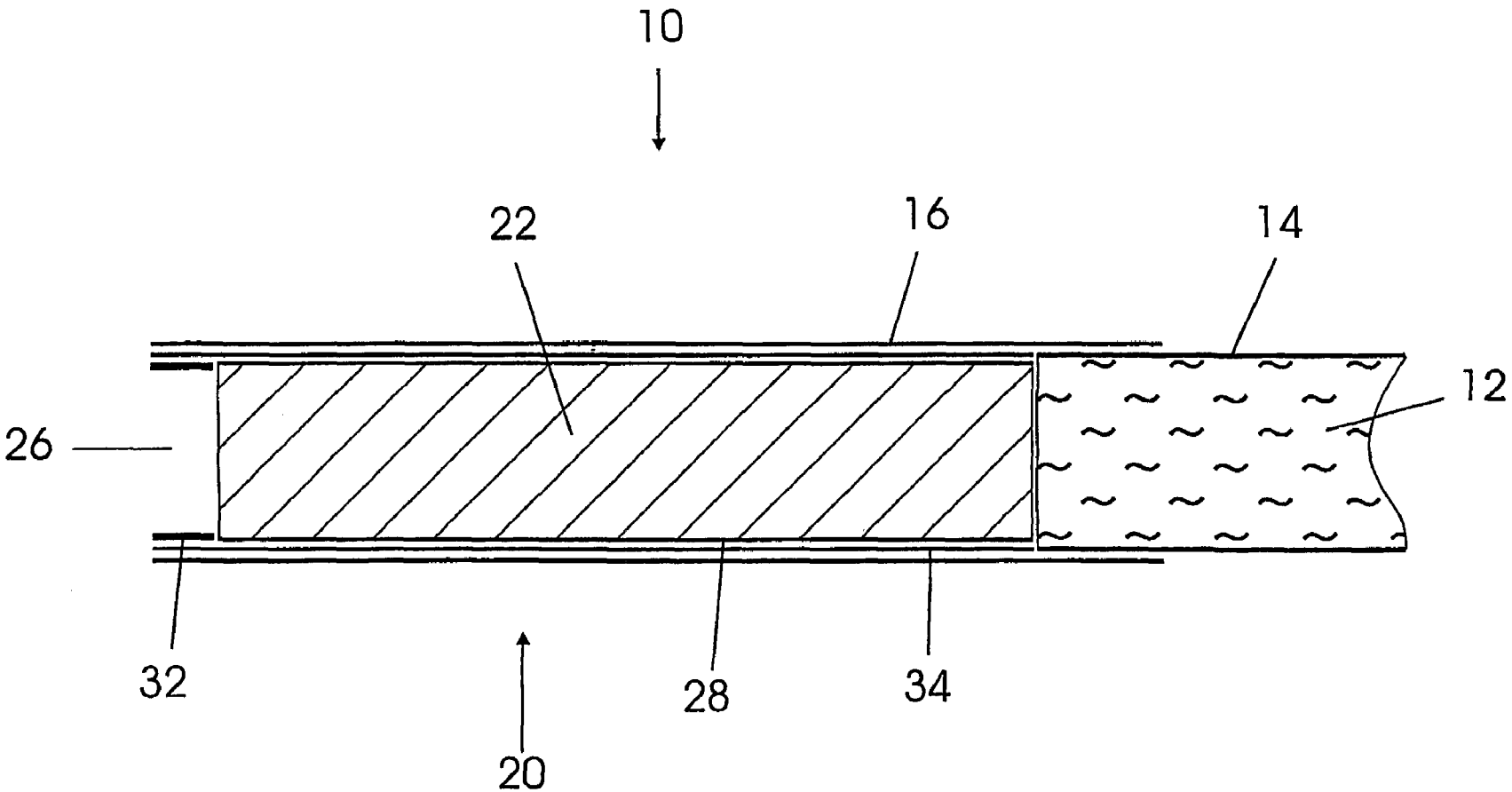

The current application relates to a recess filter, a rod comprised of several of these recess filters, and a smokeable article, in particular a cigarette or cigarillo, provided with such a recess filter.

Recess filter cigarettes or hollow mouthpiece cigarettes have been known for a long time. One type of these cigarettes, for example Papyrossis, has a completely hollow mouthpiece, which frequently becomes crushed or twisted before or during use. In another type of these cigarettes, in addition to a cavity at the mouth end, one or more filter elements are provided at the tobacco end of the mouthpiece.

Recess filter cigarettes with and without filter elements are described in GB 2 210 546 A, wherein the cavity wall is provided with perforations for the entry of ambient air and is embodied so that after use, it can be crushed in the longitudinal direction in order to thus reduce the waste volume. To this end, the cavity wall is embodied in the form of a spiral, for example.

An example of a non-ventilated recess filter cigarette can be found in DE-AS 1 056 023. But since the modern trend is toward light cigarettes, a ventilation of the filter is required.

WO 00/00047 discloses one example of a ventilated recess filter cigarette. The air-impermeable cavity wall encompasses the entire filter mouthpiece, i.e. the cavity and the filter elements. Ventilation is achieved by using a mechanically perforated cavity wall, which is encompassed by a likewise mechanically perforated covering paper. In order to then achieve a perforation of up to 90% and more, additional perforations through the covering paper, the cavity wall, and the filter wrap are also produced by means of an on-line laser during cigarette production.

WO 00/00047 thus describes two of the three processes currently used to produce ventilated recess filter cigarettes. The first of these is on-line laser perforation. However, this process has the disadvantage that it is very expensive since special equipment must be purchased for the production and this equipment also requires additional special safety precautions. Moreover, the on-line laser perforation can only achieve a maximal ventilation of approx. 65%.

The second of these methods is comprised of perforating the cavity wall material mechanically, for example by means of needles, before cigarette production. This produces relatively large holes. This perforated material is then combined with a conventional covering paper, which is likewise previously perforated, i.e. is combined with a covering paper with relatively small holes. The overlapping perforated layers cannot be glued to each other and therefore can slide in relation to each other extremely easily. This results in the fact that the relatively small holes of the covering paper and the relatively large holes of the cavity wall do not always completely or partially overlap. This undesirably results in a relatively large variation and irregularity in the ventilation. Moreover, even with mechanical perforation, only a maximal ventilation of approx. 50 to 55% can be achieved since in order to maintain the stability of the cavity wall, the perforation holes cannot be arbitrarily large. As demonstrated by the above-discussed WO 00/00047, this in turn results in the fact that for high degrees of ventilation, it is necessary to combine the two processes, on-line laser perforation and the above-mentioned mechanical perforation, which naturally makes the overall process extremely expensive and complex, without solving the problem of the ventilation variation.

The third current process is to use a cavity wall that is air-permeable per se. In this case, it is no longer necessary to perforate the cavity wall in order to produce the ventilation. However, it is disadvantageous that these air-permeable cavity wall materials are very expensive and, due to the influence of moisture, for example coming from the smoke stream or from the lips of the smoker, the stability decreases considerably and during use, the cavity can be crushed in an undesirable fashion or can collapse completely.

The object of the current invention, therefore, is to produce a ventilated recess filter and a ventilated smokeable recess filter article, which can be manufactured easily, using conventional pre-perforated covering papers. These products should be designed particularly for high degrees of ventilation, without a large degree of variation in the respective ventilation.

This attainment of this object is a smokeable article, in particular a cigarette and a cigarillo,

- with a tobacco rod, which is encompassed by cigarette paper and/or one or more tobacco sheets, and
- with a ventilated recess filter, wherein the tobacco rod and recess filter are connected to each other by an at least partially air-permeable covering paper, and wherein
- the recess filter has one or more filter elements (preferably in succession) at the tobacco end of the recess filter and a tubular cavity at the mouth end of the recess filter,
- preferably each filter element is encompassed by a filter wrap, and
- the cavity is encompassed by a (tubular) cavity wall, characterized in that
- the preferably provided filter wrap of at least one filter element is at least partially air-permeable,
- the recess filter has a ventilation of at least 10%,
- the cavity wall preferably has a porosity of 100 Coresta units or less and has no perforations,
- the cavity wall encompasses only the cavity or encompasses the cavity and the filter element or filter elements incompletely and preferably in such a way that at least at the tobacco end of the recess filter, one filter element is at least partially not encompassed by the cavity wall,
- the length of the cavity is 10 mm or less, and
- the ratio of the length of the cavity to the total length of the recess filter (including the length of the cavity) is 0.3 or less,
- and a recess filter for a smokeable article
- with one or more filter elements at a first end of the recess filter,
- with a tubular cavity at the second end of the recess filter,
- preferably with a filter wrap that encompasses each filter element, and
- with a (tubular) cavity wall that encompasses the cavity, characterized in that
- the preferably provided filter wrap of at least one filter element is at least partially air-permeable,
- the recess filter has a ventilation of at least 10%,
- the cavity wall preferably has a porosity of 100 Coresta units or less and has no perforations,
- the cavity wall encompasses only the cavity or encompasses the cavity and the filter element or filter elements incompletely and preferably in such a way that at least at the first end of the recess filter, one filter element is at least partially not encompassed by the cavity wall, the cavity wall and the filter element or filter elements, with their preferably provided filter wraps, are encompassed by an at least partially air-permeable tipping wrap, the length of the cavity is 10 mm or less, and the ratio of the length of the cavity to the total length of the recess filter (including the length of the cavity) is 0.3 or less.

The usual materials can be used for the covering paper, for example white, cork, gold, or aluminum paper, cork paper imitations, straw, silk, or rose leaves. The covering papers used are already at least partially perforated when they are produced and therefore have a sufficient air permeability to permit the desired ventilation of the filter.

The usual materials can be used for the tobacco, cigarette paper, and tobacco sheets. For example, conventional tobacco blends can be used.

The filter elements used preferably have a conventional filter wrap. This can be made of paper that has a natural porosity, thus assuring a sufficient air permeability. However, a non-porous filter wrap can also be used. But since ambient air is intended to travel into the filter element(s) from the outside, it is important that the preferably provided filter wrap of at least one filter element be at least partially sufficiently air-permeable so that for example at places in which the filter element with the air-permeable filter wrap is not encompassed on its outside by the preferably air-impermeable cavity wall, a sufficient amount of ambient air can travel into the filter from the side.

Preferably, the filter elements have a circular or oval cross section, i.e. they are the shape of circular or elliptical cylinders.

All standard filter materials can be used for the filter element, for example fibrous materials such as wadding, paper, crepe paper, cellulose, acetate fibers, plastic fibers (e.g. made of polypropylene), or cellulose acetate, or granular materials such as silica gel preparations, hydrous double silicates, activated clay, or activated charcoal, all of which can optionally contain flavorings.

One or more filter elements can be used. It is advantageous to use several, e.g. two, filter elements if the lowest possible condensate values are to be obtained or if granular filter elements are to be used. Any known filter design can be used, for example double or triple filters. Double filters can be comprised, for example, of a mouthpiece end filter element made of cellulose acetate, followed by a paper element or an element with activated charcoal. Triple filters can be comprised, for example, of a mouthpiece end filter element made of cellulose acetate, followed by an element with activated charcoal, which is adjoined in turn by an acetate filter element. One possible combination could also be a filter with a cavity in the middle, i.e. filter element/cavity/filter element.

For example, the material for the cavity wall can be paper, cardboard, or even plastic that is preferably biodegradable. The cavity wall must be thick enough to assure stability during smoking. For example, paper with a basis weight of >80 g/m$^2$, in particular 90-120 g/m$^2$, and particularly preferably approximately 110 g/m$^2$, and a thickness of >80 μm, in particular 100-140 μm, and particularly preferably approximately 125 μm can be used. A paper of this kind can be comprised of the usual components (for example kraft pulp (approx. 87.5 wt. %), anorganic filler (approx. 5 wt. %), starch (approx. 0.5 wt. %), and moisture (approx. 7 wt. %)).

For stability reasons, the cavity of the smokeable article or of the recess filter should be at most 10 mm long and is preferably only 6 mm long or even shorter. Preferably, the cavity is 4 to 6 mm long, with a total length of the recess filter of generally 20 to 40 mm and in particular 25 mm to 31.5 mm.

The cavity wall is preferably air-impermeable, i.e. it has an air permeability of 100 Coresta units or less, preferably 10 Coresta units or less, particularly preferably approximately 0 Coresta units. Ambient air can therefore travel from the outside into the filter through the pre-perforated covering paper and the preferably provided tipping wrap and filter wrap at the places that are not encompassed by the cavity wall and can provide the necessary degree of ventilation. The cavity wall can also be air-permeable per se or can be perforated. This is not required, however, since as a rule, such measures increase the material price and complicate the manufacture, and since additional perforations or air permeability downstream of the places without a cavity wall that are preferably disposed at the tobacco end of the filter, are insignificant with regard to practical use.

The diameter of the smokeable product in a normal cigarette is 7.6 to 8.4 mm and in a thin or slim cigarette, is 5.0 to 7.6 mm.

The degree of ventilation can be arbitrarily set as a function of the permeability of the filter wraps, the tipping wrap, and the covering paper. It should be at least 10% (this corresponds approximately to a condensate content in a cigarette of 12 to 14 mg), but even better at least 40% (corresponding to a condensate content of approx. 6 to 8 mg), preferably at least 60% (corresponding to a condensate content of <approx. 4 mg), and particularly preferably at least 75% (corresponding to a condensate content of approx. 1 to 2 mg). But the products according to the invention also permit the achievement of ventilations of 90% and more, for example 95%, with a condensate content of <approx. 1 mg.

It is particularly advantageous that the products according to the invention, even without the necessity in the prior art of combining different processes, permit high and very high degrees of ventilation (e.g. >90%) to be achieved, without high fluctuations of the respective ventilation, i.e. a relatively constant ventilation is achieved.

This is possible because the cavity wall only encompasses the cavity itself or encompasses the cavity and a part of the filter element or filter elements. Thus for example in an embodiment with a double filter, in addition to the cavity itself, the cavity wall can also encompass the mouth end filter element, but does not encompass or only partially encompasses the tobacco end filter element. An alternative of this embodiment is comprised in that the cavity wall encompasses the cavity itself and the tobacco end filter element, but does not encompass the intervening mouth end filter element. In an embodiment with a triple filter, for example the cavity and the mouth end filter element can be encompassed by the cavity wall, but not the middle filter element and the tobacco end filter element. Other alternatives are also conceivable for this embodiment, for example that the cavity wall encompasses the mouth end filter element and the middle filter element. (The end faces of the filter elements are naturally encompassed neither by the cavity wall nor by the filter wrap.) When the cigarette is used, therefore, in the region that is not encompassed by the cavity wall, ventilation air can enter into the recess filter through the outer covering paper, the possibly provided tipping wrap, and the filter wrap. The degree of ventilation can be controlled through the porosity of the materials used. To that end, the possibly provided filter wrap, the possibly provided tipping wrap, and the outer covering paper must be at least partially air-permeable, i.e. must have an air permeability of more than 100 Coresta units, or even better, of 200

Coresta units or more, in particular of 1000 Coresta units or more, preferably of 10000 to 20000 Coresta units or more (e.g. up to 30000), and in particular approximately 12000 Coresta units. The degree of air permeability depends on the desired degree of ventilation. Naturally, the different wraps do not have to have identical air permeabilities, but the lowest air permeability of the different wraps determines the degree of ventilation. The usual materials can be used for the wraps mentioned above, which in order to achieve the required air permeability, are either sufficiently porous by nature (e.g. conventional paper filter wraps) or can be perforated before use, for example covering papers perforated through the use of lasers or electric sparks. The necessary perforation or porosity can be provided over the entire surface of the wraps; however, it is only necessary that a sufficient ventilation be provided at places in which the filter element or filter elements is/are not encompassed by the preferably air-impermeable cavity wall. Moreover, when there are several filter elements, it is also conceivable that both filter elements are encompassed by an air-permeable filter wrap. Alternatively, one of the two filter elements can be encompassed by an air-permeable wrap, but the other can be encompassed by an air-impermeable wrap, i.e. by a filter wrap that has an air permeability of 100 Coresta units or less.

The products according to the invention can be manufactured in a number of ways. For example, a filter element (or even two or more filter elements) can possibly be provided with an air-permeable filter wrap. This filter (with or without a filter wrap) can in turn be combined with the tubular cavity wall by being wound into the tipping wrap, thus producing a recess filter. Then in a filter attaching machine, through the use of a pre-perforated covering paper, this recess filter can be attached in the usual way to the separately produced tobacco rod that is wrapped in cigarette paper or a tobacco sheet. It is not absolutely necessary to use tipping wrap. The filter element, which is possibly encompassed by the filter wrap, can also be attached directly to the tubular cavity wall at one end and to the tobacco rod at the other end by means of a covering paper in the filter attaching machine.

When two or more filter elements are used (for example the combination of an acetate filter with an activated charcoal filter), one of which is encompassed by the cavity wall, two different manufacturing processes are possible, both of which result in an identical product and both of which can be executed continuously.

In the first process, first a string of first filter plugs is produced in the tubular cavity wall. The filter plugs are twice the length of the first (mouth end) filter element of the finished recess filter and are disposed spaced apart from one another by a distance that corresponds to twice the length of the cavity. This string is then cut in the middle of the filter plugs and the pieces thus produced are combined with second filter plugs twice the length of the second (tobacco end) filter element in the finished recess filter by being wrapped in the tipping wrap. The string thus produced is then cut in the middle of every other second filter plug so that a recess filter rod four times the length of the finished recess filter is produced. (Alternatively, every third second filter plug can also be cut in the middle. This then produces a recess filter rod six times the length of the finished recess filter.)

In the second manufacturing process, this intermediary product is obtained by affixing, e.g. gluing, cavity walls in an open form to the unclosed tipping wrap. In so doing, a spacing is maintained between two cavity walls, which corresponds to twice the length of the tobacco end filter element in the finished recess filter. In the next step, a filter plug is placed between each of the open cavity walls and against its end faces adjoining the cavity walls, a filter element is applied, which corresponds to the mouth end filter element in the finished recess filter. The cavity walls and the tipping wrap are then closed (for example glued) and the string thus produced is cut in the middle of every other filter plug, which in turn produces the recess filter rod.

The recess filter rod produced using one of the two processes described above is cut in the middle in a filter attaching machine, thus producing two smaller rods, which each contain two finished recess filters, with the sequence: tobacco end filter element, mouth end filter element, cavity (with twice the length of the cavity of the finished recess filter), mouth end filter element, and tobacco end filter element. Then in the filter attaching machine, these small recess filter rods comprised of two recess filters are attached at their two ends to the tobacco rod by means of a covering paper and the product obtained is then cut in the middle again, thus producing the finished cigarettes.

An exemplary embodiment of the invention is shown in the drawings and will be described in detail below.

Figure 2:
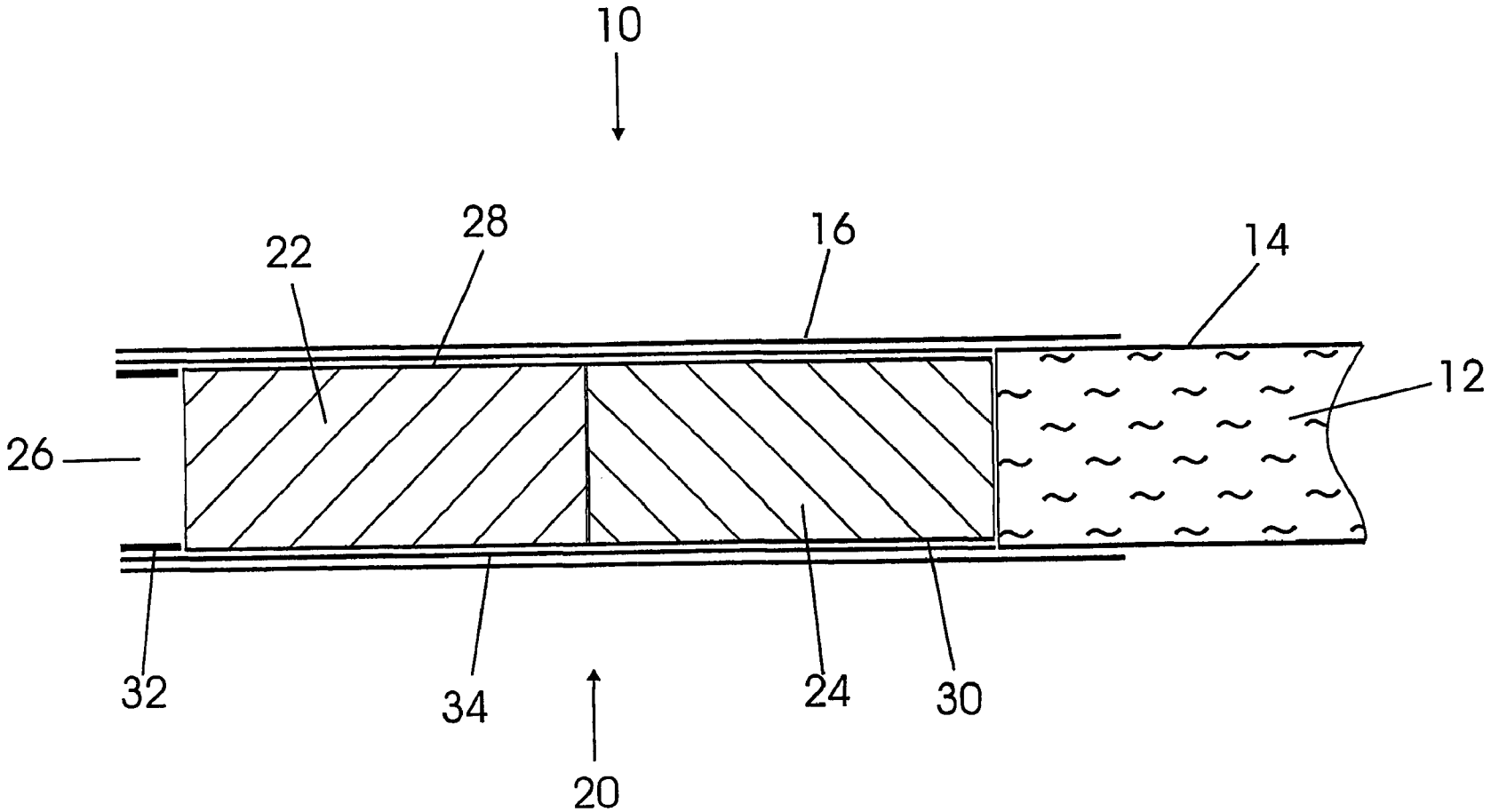
Figure 3:
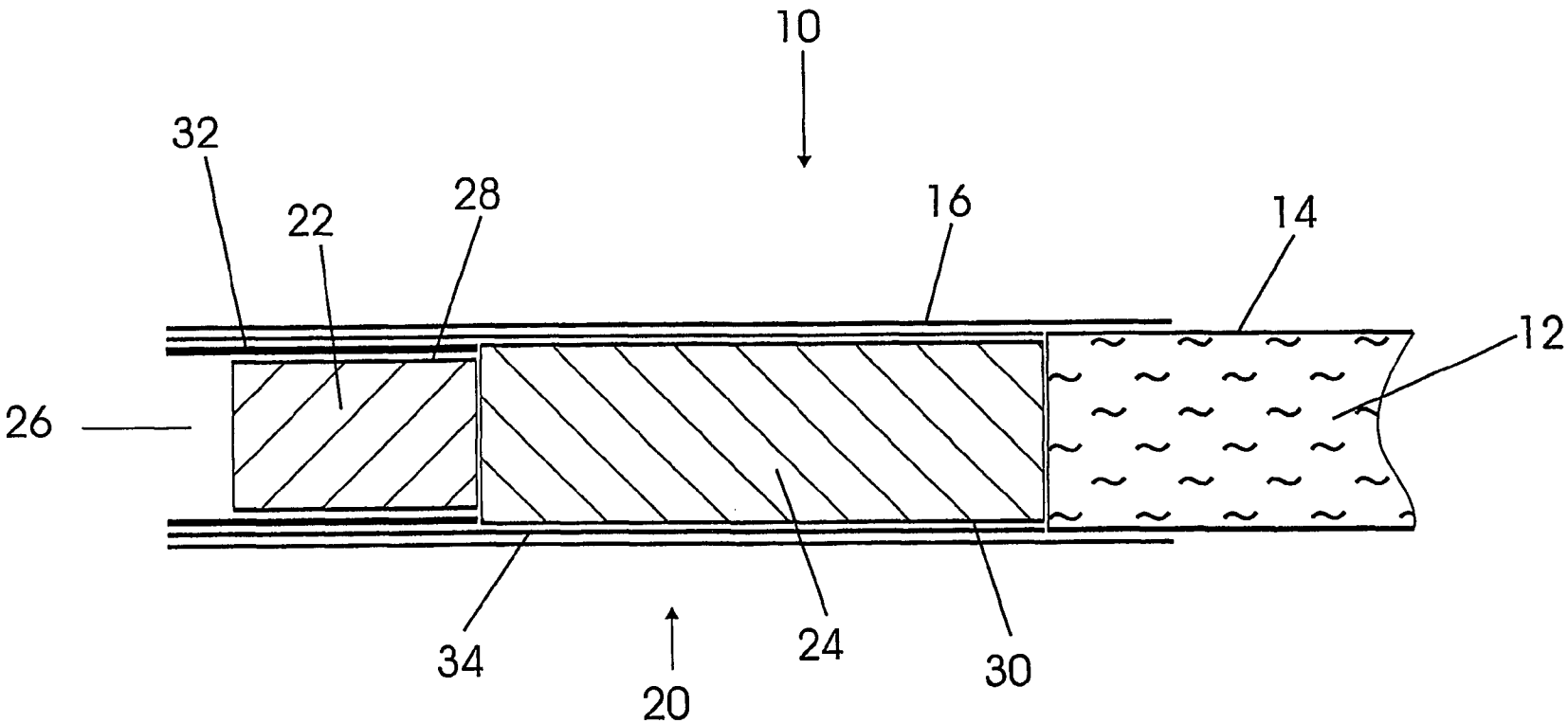
Figure 4:
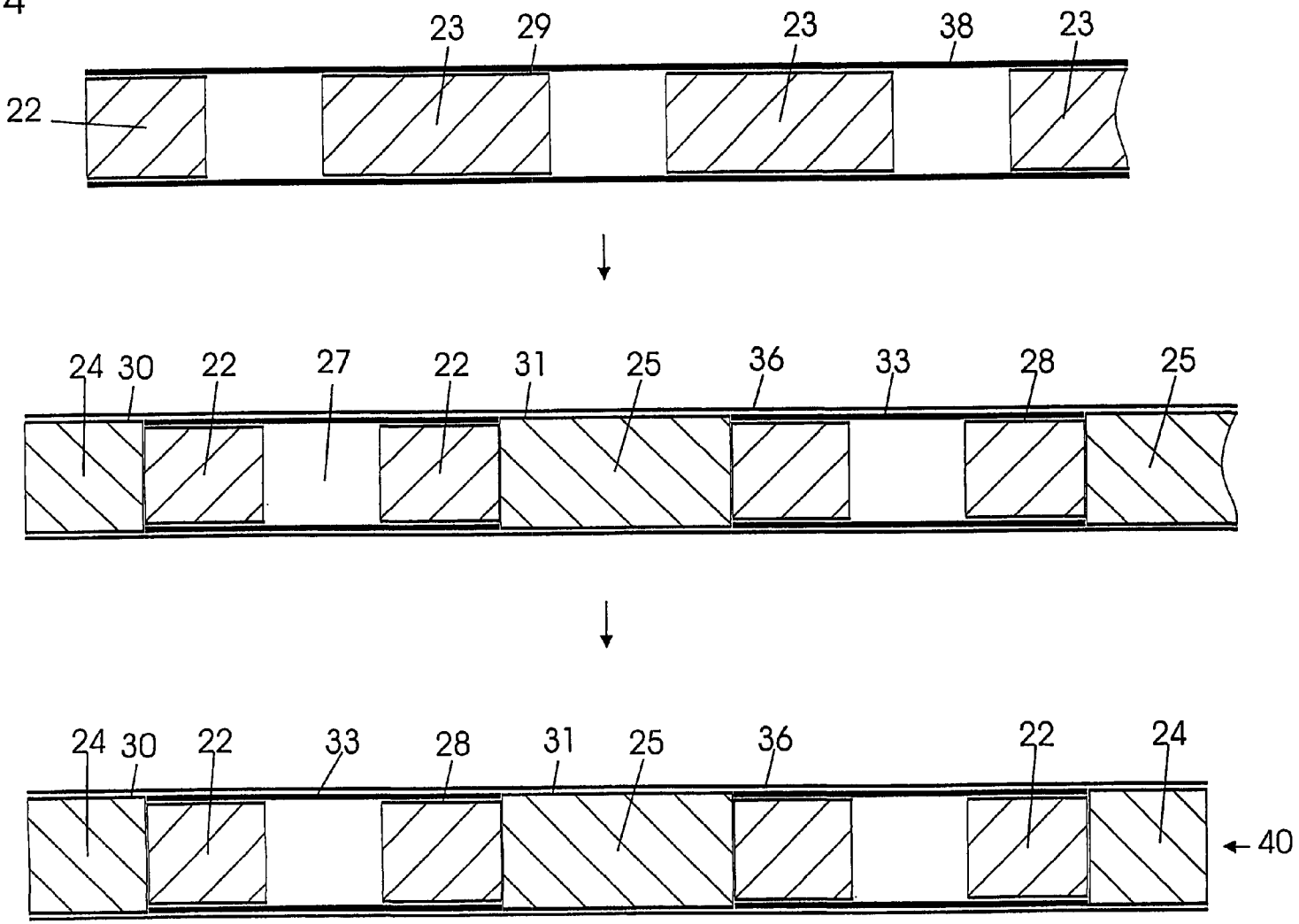
Figure 5:
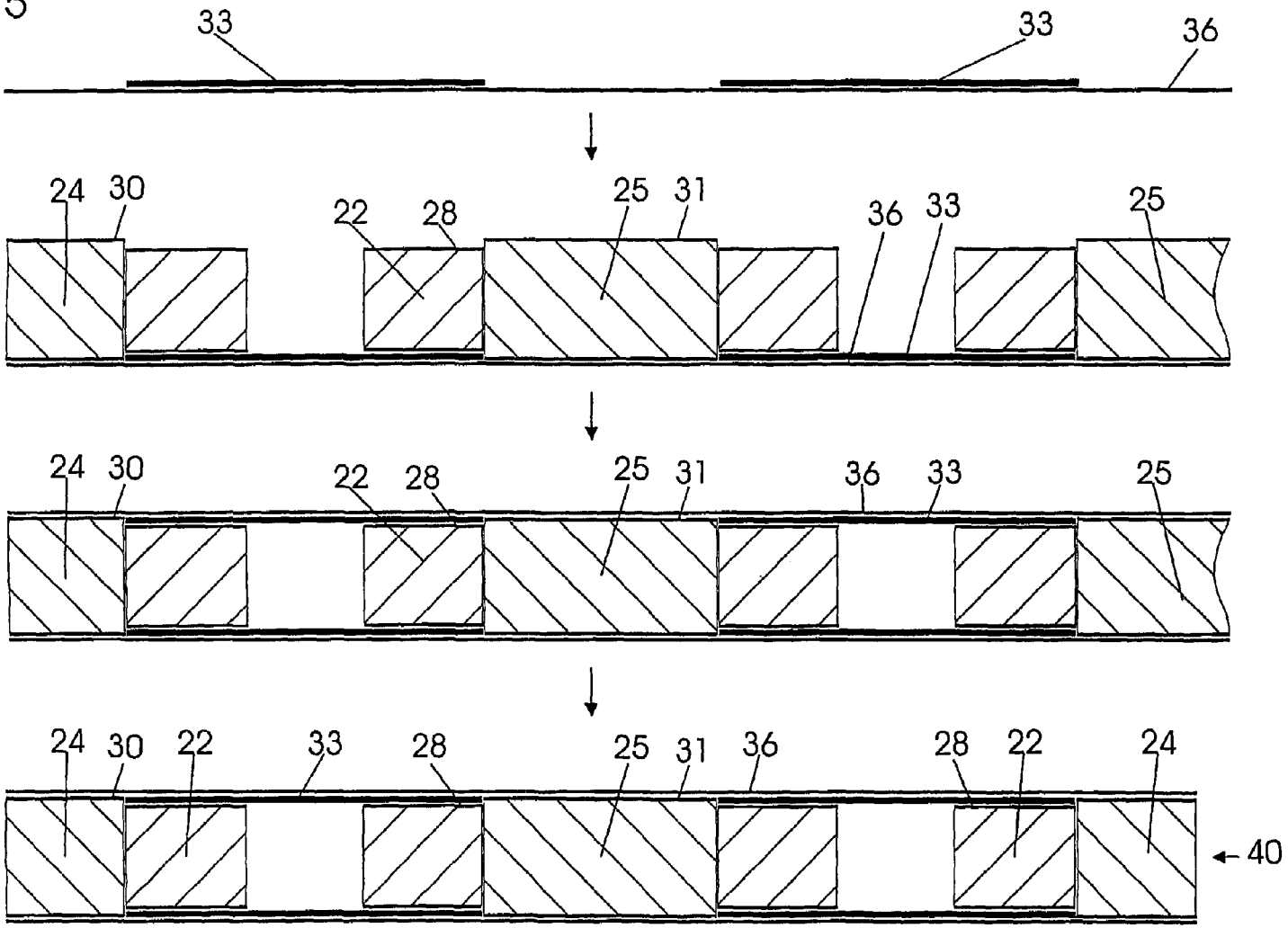
Figure 6:
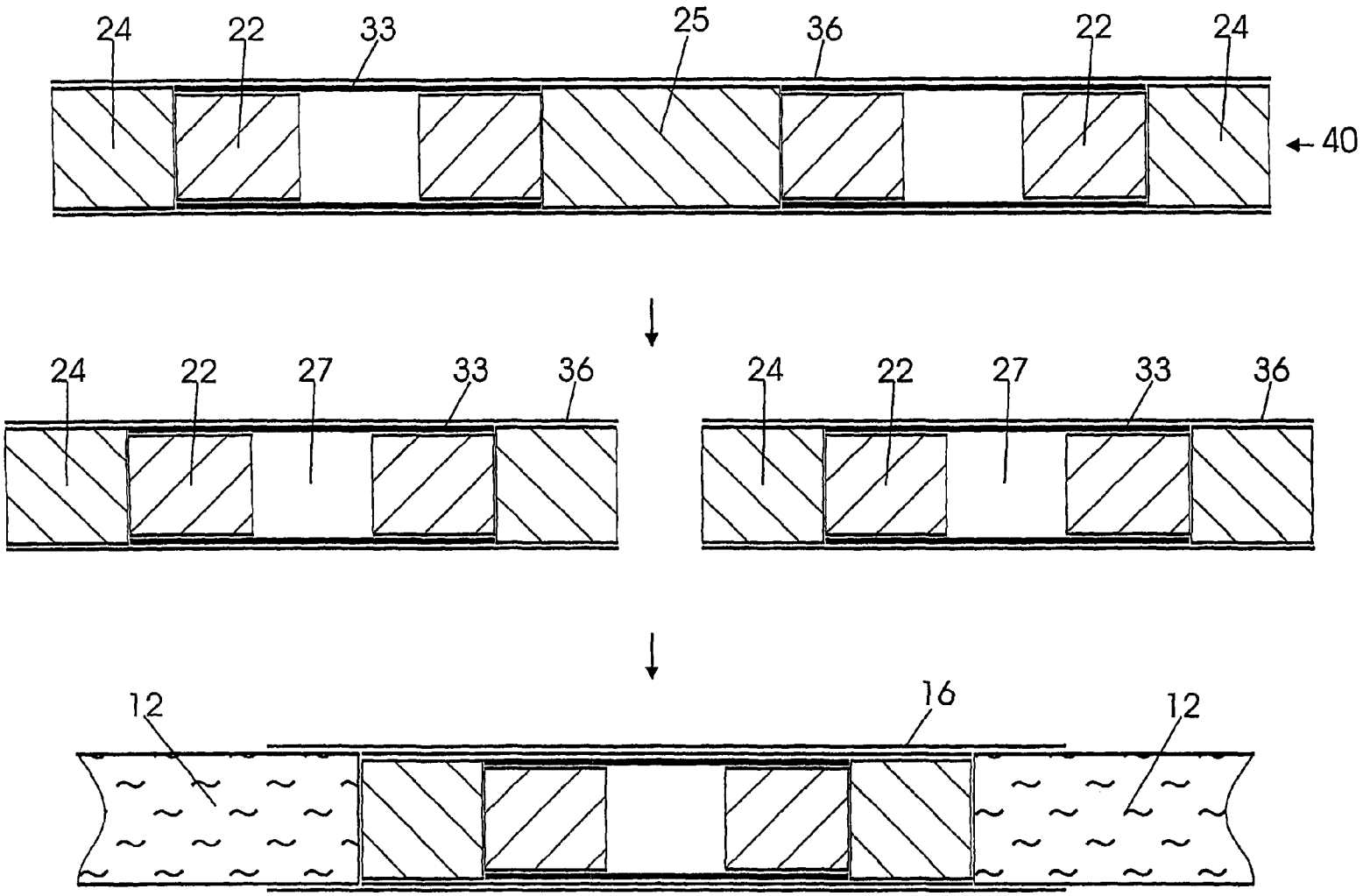

FIG. 1 shows a cross section through a recess filter according to the invention, with a filter element and a part of the adjoining tobacco rod, FIG. 2 shows a cross section through a recess filter according to the invention, with two filter elements and a part of the adjoining tobacco rod, FIG. 3 shows a cross section through a recess filter according to the invention, with two filter elements and a part of the adjoining tobacco rod, FIGS. 4 and 5 show two schematic depictions for the production of a recess filter rod four times the length of the finished recess filter, and FIG. 6 shows a schematic depiction for the production of a recess filter cigarette.

FIG. 1 shows a cigarette 10 with a partially depicted tobacco rod 12 and the encompassing cigarette paper 14. A recess filter 20 is also shown, which is attached to the tobacco rod 12 by means of a covering paper 16. The recess filter 20 has only a single filter element 22 made of acetate, which is wrapped in an air-permeable filter wrap 28. The tipping wrap 34 attaches the filter element 22 to the air-impermeable cavity wall 32, which in turn encompasses the cavity 26. When the cigarette 10 is used, air can travel into the filter 20 from the side, through the air-permeable covering paper 16, the air-permeable tipping wrap 34, and the air-permeable filter wrap 28, and can therefore provide the necessary ventilation without a large degree of variation.

FIG. 2 shows an alternative embodiment of the recess filter cigarette 10. Once again, the tobacco rod 12 is shown, which is wrapped in cigarette paper 14 and is attached to the recess filter 20 by means of the covering paper 16. The recess filter 20 here has two filter elements, namely a first filter element 22 and a second filter element 24. The first filter element 22 is wrapped in an air-impermeable filter wrap 28, the second filter element 24, however, is wrapped in an air-permeable filter wrap 30. The two filter elements 22 and 24 are in turn attached by means of the tipping wrap 34 to the air-impermeable cavity wall 32, which encompasses the cavity 26. When the cigarette 10 is puffed, ventilation air can only travel into the second filter element 24 since, due to the impermeability of the filter wrap 28 and the cavity wall 32, no ambient air can travel from the side into the first filter element 22 and into the cavity 26. Naturally, as an alternative, the reverse variant can also be selected, i.e. the filter element 24 has an air-impermeable filter wrap 30, whereas the filter element 22 has an air-permeable filter wrap 28. Another alternative is for both of the filter wraps 28 and 30 to be air-permeable.

Finally, FIG. 3 shows another embodiment for a recess filter cigarette 10. In addition to the tobacco rod 12, the cigarette paper 14, the recess filter 20, the tipping wrap 34, and the covering paper 16, this embodiment also has two filter elements, namely the first filter element 22 and the second filter element 24. The filter wrap 28 of the first filter element 22 can be air-permeable or air-impermeable. This is of no consequence since the air-impermeable cavity wall 32, which encompasses both the first filter element 22 and the cavity 26 in this embodiment, prevents ambient air from traveling into the first filter element 22 from the side. The filter wrap 30 of the second filter element 24 therefore has a high degree of permeability so that when the cigarette 10 is smoked, the second filter element 24 provides for a sufficient ventilation. An alternative to the embodiment shown is for the cavity wall 32 to not encompass the first filter element 22 completely, but to only encompass it partially.

FIGS. 4 to 6 show manufacturing possibilities for a recess filter cigarette. First, FIG. 4 shows a first possibility for manufacturing a recess filter rod 40. To that end, in a first step, first filter plugs 23, which are twice the length of the first (mouth end) filter element 22 in the finished recess filter and are encompassed by the wrapping paper 29 (likewise twice the length of the wrapping paper 28), are continuously wrapped in the air-impermeable cavity wall 38 in a machine. At the left, for the first step of FIG. 4, the one end of the string is shown, which has a filter plug 22 of the correct length. In the next step of the process (not shown in FIG. 4), the filter plugs 23 are each cut in the middle. The elements thus produced are attached to one another with a second filter plug 25, which has a wrapping paper 31 and is twice the length of the second filter element 24, by in turn being wrapped in the tipping wrap 36 in a machine, so that a string of recess filters attached to one another is produced, beginning at the left end with a second filter element 24, followed by a first filter element 22, followed by the cavity 27 with the cavity wall 33 (twice the length of the cavity 26 and the cavity wall 32 in the finished recess filter cigarette 10), followed by a first filter element 22, followed by the second filter plug 25, and so on. The recess filter rod 40, with first filter elements 22 made of cellulose acetate and second filter elements 24 made of cellulose acetate with activated charcoal granulate, is then produced by cutting the string in the middle of every other filter plug 25.

FIG. 5 shows an alternative manufacturing process for the recess filter rod 40. In this case, in the first step, the cavity wall 33 is glued to the open tipping wrap 36. As can be seen in FIG. 5, the distance between two cavity wall ends corresponds to twice the length of the tobacco end filter element 24 in the finished recess filter. In the second step of the manufacturing process, the mouth end filter elements 22, made of cellulose acetate in this case, are glued to the paper wrappings 28 at the ends of the cavity walls 33. The filter plug 25, made of cellulose acetate with activated charcoal granulate in this case, is glued with its paper wrapping 31 to the tipping wrap 36, between two respective cavity wall ends, and the continuous string is then closed in the next step. In the last step, the cut is again made in the middle of every other filter plug 25, which in turn produces the recess filter rod 40.

FIG. 6 then shows the manufacture of the final cigarette product, beginning with the recess filter rod 40. First, the recess filter rod 40 is cut in the middle of the filter plug 25, thus producing two smaller products. These are then each comprised of two recess filters connected at their mouth ends, i.e. the tobacco end second filter elements 24 are disposed at the outsides, followed by the first mouth end filter elements 22 and the cavity 27 in the middle, which is twice the length of the cavity 26 in the finished product. The first filter elements 22 and the cavity 27 are encompassed by the cavity wall 33 and the tipping wrap 36 encompasses the whole products. Then, in the last step of the process, these products are attached, i.e. glued, to the tobacco rod 12 by means of the covering paper 16, which totally encompasses the filter and the beginning region of the tobacco rod in the usual way. The product thus produced is then cut in the middle, thus producing a finished recess filter cigarette similar to the recess filter cigarette 10 shown in FIG. 3.

EXAMPLES 1-4

One of the processes described above is used to produce the recess filters 20 with two filter elements 22, 24 described in detail in Table 1, and the cigarettes 10 produced with them, wherein the cavity wall 32 encompasses the cavity 26 and the mouth end filter element 22, but not the tobacco end filter element 24. The cavity wall 32 is made of paper with the following features. Basis weight: 110 g/m$^2$, thickness: 124 μm, permeability: 0 Coresta units, tensile strength: 145 N/15 mm, components: kraft pulp approx. 87.5%, anorganic fillers approx. 5%, starch approx. 0.5%, moisture approx. 7%. The mouth or cavity end filter 22 (filter element 1) is made of cellulose acetate, the tobacco end filter 24 (filter element 2) is made of cellulose acetate with activated charcoal granulate.

TABLE 1

| | Example 1 | Example 2 | Example 3 | Example 4 |
|---|---|---|---|---|
| Filter | | | | |
| total length (in mm) | 27 | 27 | 27 | 27 |
| tipping wrap permeability[1] | 12000 CU | 12000 CU | 12000 CU | 12000 CU |
| cavity length (in mm) | 5 | 5 | 5 | 5 |
| filter element 1 | | | | |
| length (in mm) | 7 | 7 | 7 | 7 |
| draw resistance[2] | 38 | 38 | 38 | 39 |
| filter wrap permeability | air-impermeable | air-impermeable | air-impermeable | air-impermeable |

TABLE 1-continued

| | Example 1 | Example 2 | Example 3 | Example 4 |
|---|---|---|---|---|
| filter element 2 | | | | |
| length (in mm) | 15 | 15 | 15 | 15 |
| draw resistance[2] | 43 | 43 | 43 | 108 |
| filter wrap permeability[1] | 12000 CU | 12000 CU | 12000 CU | 12000 CU |
| cigarette | | | | |
| tobacco blend | American blend | American blend | American blend | American blend |
| cigarette paper permeability[1] | 34 CU | 34 CU | 34 CU | 34 CU |
| (laser pre-perforated) covering paper permeability[1] | 210 CU | 700 CU | 1650 CU | 1650 CU |
| covering paper length (in mm) | 32 | 32 | 32 | 32 |
| cigarette length (in mm) | 84 | 84 | 84 | 84 |
| diameter (in mm) | 7.9 | 7.9 | 7.9 | 7.9 |
| cigarette draw resistance[2] | 115 | 91 | 78 | 88 |
| ventilation (average in %) | 20 | 44 | 60 | 72 |
| tobacco weight (in mg) | 673 | 666 | 677 | 666 |
| condensate (in mg/cig.) | 10.9 | 7.9 | 5.4 | 2.0 |
| draw rate | 7.6 | 8.2 | 8.7 | 9.4 |

[1]in Coresta units (CU)
[2]in mm of water column

These examples show that with the recess filters 20 according to the invention, the whole condensate range of approx. 10 mg to 2.0 mg can be achieved, wherein the ventilations lie between 20 and 72%. Naturally, the ventilation can also be increased even further, which can achieve even lower condensate values.

EXAMPLE 5

In this example, a conventional product is compared to a product according to the invention. The conventional product is the cigarette with the recess filter according to the above Example 4, but in which the cavity wall 32 encloses the entire recess filter. The ventilation is achieved through mechanical perforation of the covering paper and the paper used to produce the cavity wall 32. The cigarette 10 according to the invention corresponds to the products described above in Examples 1-4, i.e. likewise cigarettes 10 with two filter elements 22, 24 corresponding to the Examples 1-3, and for the last test of Table 3, according to Example 4, in which, however, the cavity wall 32 only encloses the cavity 26 and the mouth end filter element 22. The tobacco materials and filter materials used, lengths of the filter elements, the whole filter, and the whole cigarette, and all other parameters are the same in the two cigarettes compared.

The permeability of the covering paper was varied from 720 to 2800 Coresta units for the comparison product (Table 2) and from 150-1650 Coresta units for the cigarettes according to the invention (Table 3). The results are reproduced in Tables 2 and 3.

TABLE 2

Comparison Product of the Prior Art

| covering paper permeability in Coresta units | ventilation average in % | variation coefficient in % |
|---|---|---|
| 720 | 30 | 10.3 |
| 937 | 33 | 9.7 |
| 1227 | 40 | 11.6 |
| 2105 | 50 | 7.9 |
| 2464 | 53 | 6.8 |
| 2800 | 55 | 6.7 |

TABLE 3

Cigarette According to the Current Invention

| covering paper permeability in Coresta units | ventilation average in % | variation coefficient in % |
|---|---|---|
| 150 | 16 | 6.5 |
| 210 (see Example 1) | 20 | 5.9 |
| 300 | 27 | 6.6 |
| 340 | 31 | 5.4 |
| 600 | 41 | 4.5 |
| 700 (see Example 2) | 44 | 3.6 |
| 1650 (see Example 3) | 60 | 3.4 |
| 1650 (see Example 4) | 72 | 2.9 |

The comparison shows that with the comparison product of the prior art, a ventilation of only 55% is achieved. A higher degree of ventilation cannot be achieved with the filter used since a further mechanical perforation leads to a loss of stability and problems in filter production. By contrast, it is possible to achieve a significantly higher degree of ventilation with the products according to the invention. It also turns out that with comparable degrees of ventilation, the variation coefficient of the products according to the invention are virtually half that of the comparison product.

The invention claimed is:

1. A smokeable article comprising a tobacco rod, which is encompassed by a cigarette paper, and a ventilated recess filter, the recess filter having a tobacco end and a mouth end, and wherein the tobacco rod and recess filter are connected to each other by an at least partially air-permeable covering paper, wherein:

the recess filter has one or more filter elements at the tobacco end of the recess filter and a tubular cavity at the mouth end of the recess filter, the cavity is encompassed by an air-impermeable cavity wall having no perforations, the recess filter has a ventilation of at least 10%, the air-impermeable cavity wall encompasses only the cavity or encompasses the cavity and at least one of the one or more filter elements, the cavity wall and the one or more filter elements are encompassed by an at least partially air-permeable tipping wrap, the tipping wrap attaches the one or more filter elements to the cavity wall, the length of the cavity is 10 mm or less, a ratio of a length of the cavity to a total length of the recess filter including the length of the cavity is 0.3 or less, and wherein the cavity wall encompasses the cavity and the one or more filter elements in such a way that at least at the tobacco end of the recess filter, one filter element is at least partially not encompassed by the cavity wall.

2. The smokeable article according to claim 1, wherein the cavity wall has a porosity of 100 Coresta units or less.

3. The smokeable article according to claim 1, wherein each of the one or more filter elements is encompassed by a filter wrap and at least one of the filter wraps is at least partially air-permeable.

4. The smokeable article according to claim 1, wherein the at least partially air-permeable tipping wrap is disposed between the covering paper, and the cavity wall and the one or more filter elements.

5. The smokeable article according to claim 1, wherein the filter elements are the shape of circular or elliptical cylinders.

6. The smokeable article according to claim 1, wherein the ventilation of the recess filter is at least 40%.

7. The smokeable article according to claim 1, wherein the length of the cavity is 6 mm or less.

8. The smokeable article according to claim 1, wherein the length of the cavity is 4 to 6 mm and the total length of the recess filter is 20 to 40 mm.

9. The smokeable article according to claim 1, wherein the diameter of the smokeable article is 5.0 to 8.4 mm.

10. The smokeable article according to claim 1, wherein the ventilation of the recess filter is at least 60%.

11. The smokeable article according to claim 1, wherein the ventilation of the recess filter is at least 75%.

12. The smokeable article according to claim 1, wherein the length of the cavity is about 5 mm and the total length of the recess filter is 25 to 31.5 mm.

13. The smokeable article according to claim 1, wherein the one or more filter elements comprises a first filter element having an air-impermeable filter wrap and a second filter element having an air-permeable filter wrap.

14. The smokeable article according to claim 1, wherein the one or more filter elements comprises a first filter element encompassed by the air-impermeable cavity wall and a second filter element having an air-permeable filter wrap.

15. A recess filter for a smokeable article comprising one or more filter elements at a first end of the recess filter, a tubular cavity at a second end of the recess filter, and having an air-impermeable cavity wall that encompasses the cavity, wherein:

the recess filter has a ventilation of at least 10%, the air-impermeable cavity wall encompasses only the cavity or encompasses the cavity and at least one or more of the filter elements, the cavity wall has no perforations, and the cavity wall and one or more filter elements are encompassed by an at least partially air-permeable tipping wrap, the tipping wrap attaches the one or more filter elements to the cavity wall, a length of the cavity is 10 mm or less, a ratio of the length of the cavity to a total length of the recess filter including the length of the cavity is 0.3 or less, and wherein the cavity wall encompasses the cavity and the one or more filter elements in such a way that at least at the tobacco end of the recess filter, one filter element is at least partially not encompassed by the cavity wall.

16. The recess filter according to claim 15, wherein the cavity wall has a porosity of 100 Coresta units or less.

17. The recess filter according to claim 15, wherein each of the one or more filter elements is encompassed by a filter wrap and at least one of the filter wraps is at least partially air-permeable.

18. The recess filter according to claim 15, wherein the filter elements are the shape of circular or elliptical cylinders.

19. The recess filter according to claim 15, wherein the ventilation of the recess filter is at least 40%.

20. The recess filter according to claim 15, wherein the length of the cavity is 6 mm or less.

21. The recess filter according to claim 15, wherein the length of the cavity is 4 to 6 mm and the total length of the recess filter is 20 to 40 mm.

22. The recess filter according to claim 15, wherein the diameter of the recess filter is 5.0 to 8.4 mm.

23. A recess filter rod, which is comprised of a number of recess filters according to claim 15, wherein the mouth ends of the recess filters are attached to the mouth ends of the adjacent recess filters and the tobacco ends of the recess filters are attached to the tobacco ends of the adjacent recess filters.

24. The recess filter rod according to claim 23, which is comprised of 2, 4 or 6 recess filters.

25. The recess filter according to claim 15, wherein the ventilation of the recess filter is at least 60%.

26. The recess filter according to claim 15, wherein the ventilation of the recess filter is at least 75%.

27. The recess filter according to claim 15, wherein the length of the cavity is about 5 mm and the total length of the recess filter is 25 to 31.5 mm.

28. The recess filter according to claim 15, wherein the one or more filter elements comprises a first filter element having an air-impermeable filter wrap and a second filter element having an air-permeable filter wrap.

29. The recess filter according to claim 15, wherein the one or more filter elements comprises a first filter element encompassed by the air-impermeable cavity wall and a second filter element having an air-permeable filter wrap.

* * * * *